US006575266B1

(12) United States Patent
Gehse et al.

(10) Patent No.: US 6,575,266 B1
(45) Date of Patent: Jun. 10, 2003

(54) TUBE BARREL WEAPON

(75) Inventors: Hartmut Gehse, Tulpenweg 3, 88677, Markdorf (DE); Gerhard Wedekind, Max-Josefsplatz 20a, 83022, Rosenheim (DE)

(73) Assignees: Hartmut Gehse, Markdorf (DE); Gerhard Wedekind, Rosenheim (DE)

( * ) Notice: Subject to any disclaimer, the term of this patent is extended or adjusted under 35 U.S.C. 154(b) by 0 days.

(21) Appl. No.: 09/704,214

(22) Filed: Jul. 14, 2000

Related U.S. Application Data

(63) Continuation-in-part of application No. 09/321,641, filed on May 28, 1999, now abandoned.

(30) Foreign Application Priority Data

May 29, 1998 (DE) ..... 198 24 010

(51) Int. Cl.[7] ..... F41A 21/00
(52) U.S. Cl. ..... 181/223; 89/14.4
(58) Field of Search ..... 181/223, 249, 181/232; 89/14.4; 42/79

(56) References Cited

U.S. PATENT DOCUMENTS

| | | | | |
|---|---|---|---|---|
| 1,080,154 A | | 12/1913 | Moore | |
| 1,127,250 A | | 2/1915 | Humm | |
| 1,770,471 A | | 7/1930 | Hatcher | |
| 2,101,849 A | * | 12/1937 | Green | 89/14 |
| 2,447,205 A | * | 8/1948 | Powell | 42/79 |
| 2,503,491 A | | 4/1950 | Janz | |
| 3,478,841 A | | 11/1969 | Hubner | |
| 3,667,570 A | | 6/1972 | Werbell | |
| 4,928,573 A | * | 5/1990 | Fansler et al. | 89/14.4 |
| 5,078,043 A | | 1/1992 | Stephens | |
| 5,983,772 A | | 11/1999 | Reynolds et al. | |

FOREIGN PATENT DOCUMENTS

| | | | | |
|---|---|---|---|---|
| DE | WO 8903958 A1 | * | 5/1989 | 89/14.4 |
| DE | 39 40 807 A 1 | | 6/1991 | |
| DE | 42 07 843 C 2 | | 2/1994 | |
| EP | 70612 A2 | * | 1/1983 | 42/79 |
| GB | 2 156 053 A | * | 10/1985 | F41B/11/00 |

* cited by examiner

*Primary Examiner*—Robert E. Nappi
*Assistant Examiner*—Edgardo San Martin
(74) *Attorney, Agent, or Firm*—Antonelli, Terry, Stout & Kraus, LLP

(57) ABSTRACT

A device on the tube barrel of a tube weapon, more particularly on an aircraft cannon. It comprises a bottle, arranged on the muzzle end of the tube barrel by means of holding means, which serves to take up a shock wave at the muzzle. The bottle possesses a rear opening and following same in the direction of shooting a front opening, through which a fired projectile leaves the bottle. A blast divider tube, extending in the direction of shooting, is inserted into the front opening of the bottle, and serves as a passage through which the projectile passes. The blast divider tube also divides the bottle into an expansion space between the divider tube and the muzzle and a blind space toward the front.

7 Claims, 3 Drawing Sheets

TUBE BARREL WEAPON

This is a continuation of Ser. No. 09/321,641 filed May 28, 1999 abandoned.

BACKGROUND OF THE INVENTION

Field of the Invention

The invention relates to a device mounted on the tube barrel of a weapon, especially on an aircraft cannon to act as an acoustical wave suppressor or muzzle-brake. A casing tube is attached at the muzzle end of the tube barrel by a holding means, and serves to take up a shock wave at the muzzle. The casing tube possesses a rear opening and, aligned in the direction of shooting, a front opening, through which a fired projectile exits.

BACKGROUND AND PRIOR ART

Upon firing a projectile by a cannon there is, in addition to the weapon recoil force, a shock wave at the muzzle of the barrel of the cannon. This wave produces a violent surge of acoustic pressure. The blast wave moves away from the muzzle in the form of a vortex ring. The pressure field of this vortex ring causes the structural loading with alternate over-pressure followed by under-pressure. All adjacent structures are affected and all the equipment arranged at this point, most particularly sensor systems, are subjected to a high dynamic load.

In order to reduce these effects of the shock wave there has been a suggestion in the prior art for a muzzle brake combined with a casing tube termed a "shock wave accumulator". Since in the art such a casing tube is also termed a "bottle" or "blast bottle", the term "bottle" will continue to be employed herein for the sake of uniform terminology.

The German patent publication DE 3,940,807 A1 describes such a bottle as a protective device for reducing the effects of a shock wave and of the recoil force on firing a cannon, especially one installed in aircraft.

The principle adopted here in the prior art is that the muzzle of the cannon barrel is placed in a bottle, so that between the cannon barrel and the bottle there is an intermediate space. The bottle has a muzzle brake of known type at its front end with an opening for the passage of the fired projectile and means (vanes) for deflection of the gases from the propellant charge into a direction opposite to the direction of shooting. At the rear end of the bottle a further opening is arranged for discharge of the propellant gases. In the case of this known protective device only a part of the shock wave is affected. The portion of the shock wave affected is dependent on the dimensions of the muzzle brake and is extremely limited owing to the relatively narrow passage openings. The deflection means has the effect that a part of the shock wave is deflected into the bottle, i.e. passed in a direction opposite to the direction of shooting into the rear space of the bottle and escapes after only one pass through the rear opening of the bottle. A substantial fraction of the shock wave leaves the cannon barrel through the front opening and continues to produce undesired dynamic loads on the aircraft structure and electronic components.

There is admittedly a desired effect, but the efficiency of the protective device can be substantially improved. The potential damping effects are not employed in an optimum fashion. As electronic components of military aircraft become increasingly sophisticated the need for efficient and compact muzzle brakes increases.

BRIEF SUMMARY OF THE INVENTION

One object of the invention in the preferred context of aircraft is to substantially reduce the shock wave load and also the weapon recoil of a tube weapon as related to the airframe structure and the electronics of the aircraft.

This object is to be attained by attaching to the muzzle of a tube weapon an expansion chamber. The expansion chamber is generally circular in cross section and an elongated oval in sagittal section. A tube called a blast divider tube projects inwardly from the end of the expansion opposite to the muzzle along the longitudinal axis. The projectile leaving the muzzle enters and passes through the blast divider tube while muzzle blast gasses and the acoustical shock waves are deflected and broken up within the bottle.

DETAILED DESCRIPTION OF THE INVENTION

Figure 1:
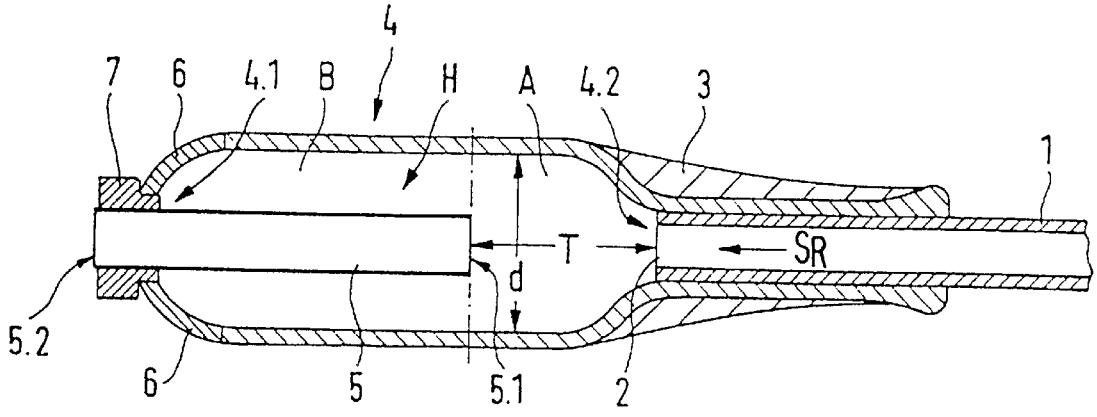
FIG. 1 shows a diagrammatic view of the device of the invention.

The bottle of this invention will be described in terms of a front, which is the portion away from the attachment point of muzzle and rear, which attaches to the muzzle.

The bottle has a rear opening placed over the muzzle of the barrel direction. Accordingly the rear opening and the front opening of the bottle are aligned in the direction of shooting, i.e. on the axis of shooting. A holding means, which surrounds the barrel, bears the weight of the bottle and positions the rear opening of the bottle in an interlocking manner on the muzzle of the barrel. Loads which result on blast reflection at the front end of the bottle are transmitted via the wall of the bottle neck to the bottle holding means and not via internal webs, as in the case of the muzzle brake of the publication DE 3,940,807 A1. This means that there is maximum expansion of the principal blast coming out of the tube muzzle.

At the front opening 5.2 of the bottle 4 is mounted a blast divider tube 5, which is also aligned in the direction of shooting. The inner opening 5.1 of the divider tube projects into the space inside the bottle. The term inner opening is employed to mean that this opening of the blast tube is arranged within the space in the bottle. The internal opening of the blast divider tube is the point at which the bottle space is divided conceptually into two spaces or chambers. There is an expansion space T, which is defined as the volume between the inner opening 5.1 of the blast divider tube and the end 2 of the muzzle barrel 1, and a blind space H, which is the volume surrounding the length of the blast divider tube present in the bottle space. The relative sizes of the two chambers may be changed by changing the length of the blast divider tube or, more finely, by adjusting the mounting.

The free passage into the expansion space offers the advantage that the gas emerging from the barrel (shock wave) may expand with an explosive action into a relatively large space (the expansion space). There is in this space no obstruction owing to narrow inlet slots or other forced deflection using internal deflection means. The expansion space may also extend a small distance to the rear past the opening of the barrel opposite to the direction of shooting in order to be able to adjust the point in time of a second internal reflection within the space.

Following the natural direction of propagation, the gas front expands past the inner opening of the blast divider into the blind space, except for a small fraction of the gas, which passes through the inner opening of the blast divider tube directly behind the projectile. The blind space possesses a relatively large inlet opening. It is possible to make the shape of the blind space such that it tapers toward the front, so that its effective length is somewhat reduced and the incident blast is focused. Such a taper may be desired for aerodynamic reasons.

The opening of the blast divider tube should be of minimum size so that there is just enough clearance to ensure free passage of the projectile. Free passage means that the projectile is just able to get past the blast divider tube without jamming. Accordingly the magnitude of the first blast exiting the blast bottle is reduced compared with a muzzle having no brake and the recoil of the weapon is reduced. The bore diameter of the blast divider tube may be flared out toward the outer opening after the choke point in order to ensure free passage for a wobbling projectile.

The invention renders it possible to achieve both reduction of the recoil force of the weapon and also the shock wave. Also the size and weight will be substantially less. The momentum or pulse on reflection of the shock wave at the end of the blind space leads to a force opposite in direction to the recoil from firing the projectile, such force increasing in size with the degree of success in deflecting the primary blast from the tube muzzle into the blind space.

Multiple internal reflection of the pressure waves within the blast bottle causes the pressure with the bottle to be released. Thus the recoil is "damped" and approaches a constant pressure release instead of a sudden blast, something which substantially reduces the acoustic load on the structure of the aircraft.

Between the end, within the bottle space, of the blast divider tube and the opening or muzzle of the barrel the distance is selected so that the first blast is reflected at the wall of the expansion space and then reflected off of the outer surface of the blast divider tube into the blind space so that the reflected wave cannot enter the inner opening of the blast divider tube.

The diameter and the depth of the expansion space have an effect on the position of a focusing region, which occurs after the blast front is reflected at the wall of the expansion space. The position of this focusing region is optimum, when it is at, or downstream from, the inner opening of the blast divider tube.

The diameter and more particularly the length of the blind space determine the point in time at which the blast wave reflected in this space comes back to the inner opening of the blast divider tube. This should occur before the principal blast emerging from the tube muzzle reaches its maximum. When the reflected wave reaches the opening of the divider tube it cannot turn directly 180° into the divider tube due to the high pressure. A Prandtl-Meyer expansion will not allow such a turn angle. For a theoretical explanation, see Saad, M A, *Compressible Fluid Flow*, $2^{nd}$ ed., Prentice Hall (1973). This means that the reflected blast impairs unhindered passage of the trailing gas through the inner opening of the blast divider tube. This causes enormous flow losses.

The diameter of the bottle may be limited by other design factors of the aircraft, which may limit the effectiveness of the bottle.

If both the diameter and also the depth of the expansion space are set by structural features of the aircraft, with a further development of the invention it is possible for the length of the blast divider tube extending in the bottle to be made adjustable so that the characteristics of the munitions being used, especially caliber and muzzle velocity can be accommodated by adjusting the mounting.

It has been found that the optimal length of the blast divider tube within the bottle should be between 40 and 85% of the total length of the blast bottle. Preferredly, the length of the tube is 50 to 85%, most preferredly 60 to 85% of the total length. Further, it has been found that the distance between the end of the blast divider and the mouth of the muzzle should be between 50 and 150% of the inner diameter of the bottle, preferredly 70 to 150%, most preferredly 85 to 150%. These relationships are tuned to the physical limitation imposed by the design of the aircraft and the munitions being used.

The invention will now be described with reference to one example as illustrated in accompanying drawings.

It will be clearly seen from the diagrammatic view of the device depicted in FIG. 1 that the bottle space H included within the bottle 4 is essentially arranged downstream from the muzzle 2 of a tube barrel 1 aligned in the direction $S_R$ of shooting.

The bottle 4 possesses a rear opening 4.2 and a front opening 4.1. The bottle 4 is mounted so that its rear opening 4.2 fits in an interlocking manner on the muzzle 2 of the tube barrel 1. A holding means 3, which surrounds the tube barrel 1 at the muzzle, carries the weight of the bottle 4. At the front opening 4.1 of the bottle 4 a blast divider tube 5 is mounted by means of a carrier 7 aligned in the direction $S_R$ of shooting. The blast divider tube 5 has its inner opening 5.1 in the bottle space H. The outer opening 5.2 of the blast divider tube at the same time constitutes the effective opening of the bottle 4 and the weapon when in use. The inner opening 5.1 of the blast divider tube 5 constitutes the point of division between the bottle space H into two spaces or chambers, that is to say the expansion space A and the blind space B. The expansion space A is characterized by the diameter d and the depth T which is the distance between 5.1 and 4.2. The blind space B is a dead space, which does not have any exit. The blind space extends from the expansion space as far as the front wall of the bottle. The front wall fo the bottle 4 may simultaneously be designed to constitute deflection means 6.

Figure 2A:
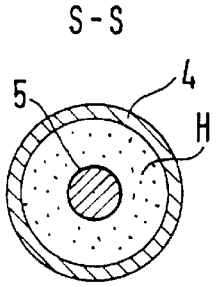
FIG. 2*a* shows a section S—S taken through the expansion chamber.

In the expansion space A it is possible for the gas emerging from the tube barrel in an explosive manner to expand. In the blind space B the gas will expand further, separated from the fraction of the gas, which passes directly through the divider tube 5 behind the projectile. The blast divider tube 5 should be of minimum diameter and just permit the free passage of a projectile. In case of need it is possible for the blast divider tube to be flared toward the inner opening in order to permit free passage of a wobbling projectile. As shown in FIG. 2*a* this blast may expand in its "natural" direction (corresponding to the direction of shooting) with a maximum "aperture" into the blind space B. Only a small part of the first blast is released into the surroundings through the blast divider tube 5.

Figure 2:
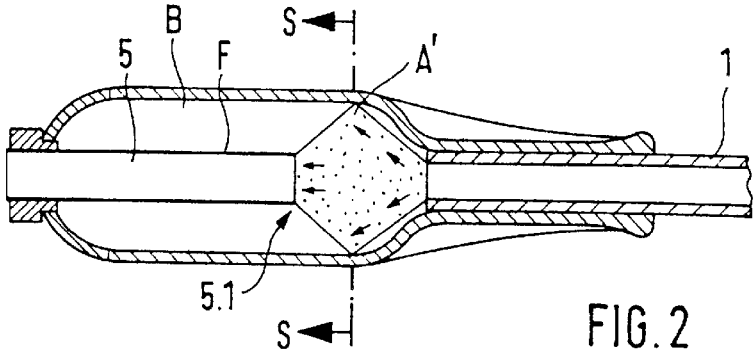
FIG. 2 is diagram of the development of flow at the point in time of entry of the blast into expansion space and of focusing.
Figure 3:
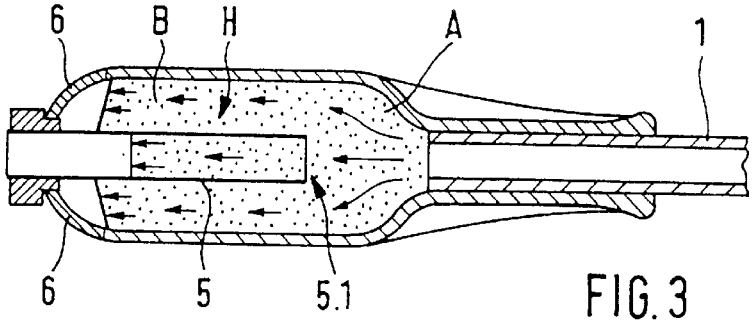
FIG. 3 indicates the development of flow following cutting off of path of the flow by the casing and into the blind space.
Figure 4:
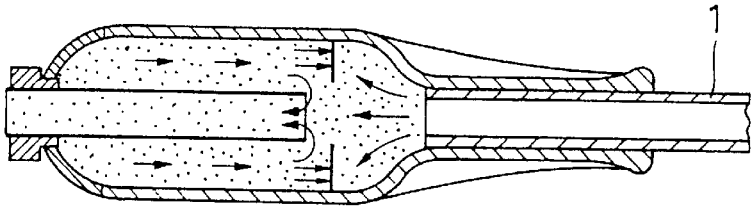
FIG. 4 shows the development of flow as a continuation of FIG. 3.

FIGS. 2, 3, and 4 serve to diagrammatically explain the changes with time in flow in the bottle space on firing of a projectile. In this respect it is possible to assume the following basic conditions. The blast velocity in the bottle space H may be in a range of 400 to 1000 m/s. The time the blast maximum is reached in front of the outer opening 5.2 of the blast divider tube 5 in the vicinity of the aircraft structure amounts to approximately 0.5 ms. A mean blast pressure ratio of 50 at the muzzle 2 of the tube barrel 1 is assumed.

Under these basic conditions the blast, which is caused by the gas emerging from the muzzle 2, will reach the inner opening 5.1 of the blast divider tube 5 in about 0.1 ms. To the side the blast has strong expansion regions ("effective" angle of the cone of emergence is 30° to 45°) so that firstly, in the region A' in FIG. 2 there will be a substantial blast reflection at the wall of the expansion space A. This reflected blast will reach the region of the shooting axis firstly in the focus region F, which has a position at, or downstream from, the inner opening 5.1 of the blast divider tube 5. The projectile should at this point in time be in the vicinity of the inner opening 5.1. The vortex ring which normally would form in already being broken down by the bottle.

The blast in the blind space B reaches its front wall and is reflected at above 0.3 ms. The gas between the front wall and the reflected blast is caused to come to a halt and reaches extremely high pressures of about 50 bar and resulting in temperatures of up to 1000° K. The time for movement of the blast back and forth in the blind space B should be so long that the reflected blast reaches the inner opening 5.1 of the blast divider tube 5 long before the flow from the muzzle 2 has fully developed, i.e. long before the maximum blast momentum would have been reached. This time should for example be 0.6 ms. This period of time sets the length of the blind space B. Accordingly the length of the blind space B should be form 0.1 to 0.2 m for typical aircraft cannon. The projectile will at this time still be within the blast divider tube 5.

As shown in FIG. 4 the reflected blast in the blind space B will reach the inner opening 5.1 of the blast divider tube. In the blind space B the flow is brought to a halt as the pressure subsides. During further progression of the blast it will "choke" the flow still present in the expansion space A toward the blast divider tube. Because the reflected shock wave has the greater pressure, the shock wave cannot dissipate into the divider tube.

Figure 5:
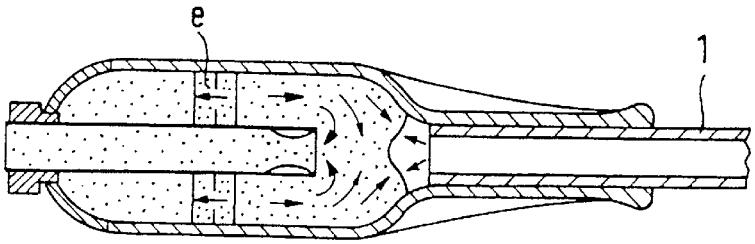
FIG. 5 shows the development of flow as a continuation of FIG. 4.

As further depicted in FIG. 5, after a time of approximately 0.6 ms the reflected blast will reach the muzzle 2 and will prevent further blowing off of gas from the tube barrel 1, because a part of it will pass into the tube barrel 1. The other part is reflected again and the cycle is repeated. An expansion fan e (FIG. 5) will spread out in the blind space B and will accelerate the gas again toward the inner opening 5.1. Since the inner opening 5.1 of the blast divider tube 5 is designed with sharp edges, with the extremely high pressures existing only a maximum effective deflection again of approximately 120° is possible. Accordingly there is extremely pronounced detachment and pinching of the flow in the vicinity of the muzzle, which considerably hinders the emergence of the gas. It is in this manner that the muzzle blast is split up into a multiplicity of small blasts and effectively converged into a beam or jet, which puts a much smaller load on the aircraft structure than the prior art designs.

Figure 6:
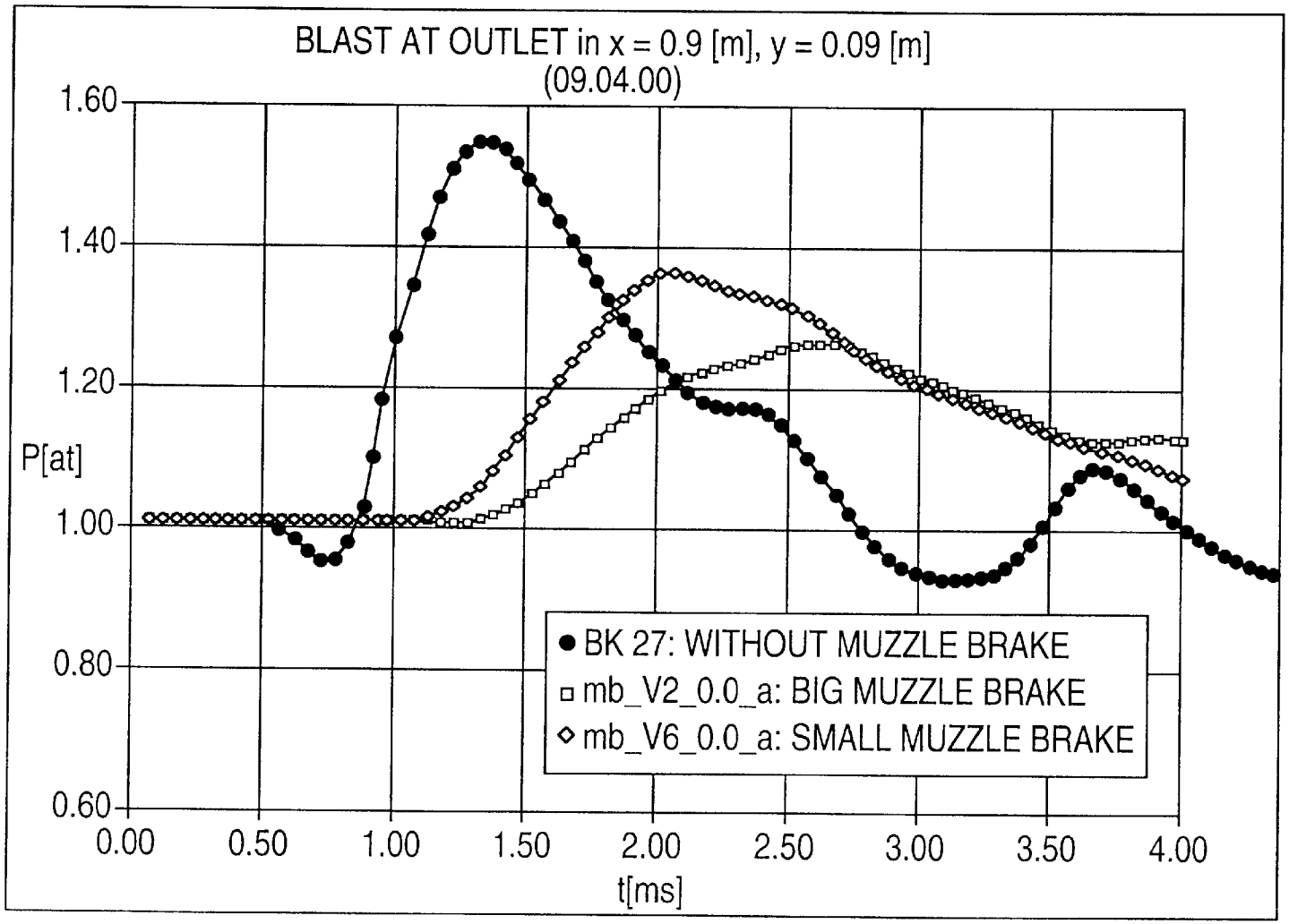
FIG. 6 shows a comparison of the blast pulses calculated for a 27 mm. cannon without a muzzle brake and with two sizes of blast bottle muzzle brakes.

FIG. 6 illustrates the effectiveness of the muzzle brake of this invention. The model cannon is a Mauser BK 27 machine gun of caliber 27 mm, firing a round having an 85 g explosive load. The solid curve compares calculated pressures over time at 0.9 m from the muzzle for the cannon without muzzle brake. The hollow squares correspond to the same calculation using a muzzle break of this invention having a 31 mm diameter divider tube, an overall length of 200 mm, a diameter of 100 mm and a divider tube length of 100 mm. The hollow diamonds correspond to a muzzle brake 150 mm long, 65 mm in diameter with a 90 mm divider tube.

It is noted that the smaller muzzle brake in less efficient for reasons relating to the higher pressures in the blind space, which causes an increase in temperature and propagation rate. The result is higher pressure, a sharper acoustical signature, and a more obvious visual signature.

The invention has been described in its preferred embodiment. Its application to other firearms and other weapons systems such as armored vehicles is within the scope of the invention. The scope of the invention is not limited to these embodiments but encompasses modifications and additions as would be apparent to those skilled in the art.

We claim:

1. An acoustical wave suppressor for a tube barrel weapon comprising:

a. a substantially tubular main body having a length and having a diameter greater than the outer diameter of the tube barrel weapon, and in a coaxial relationship relative to the axis of the tube barrel weapon;

b. a first closed end closing said tubular main body at a first end, said first closed end being solidly mounted to a muzzle of the tube barrel weapon, and having an opening to said muzzle;

c. a second closed end closing said tubular main body at a second end, said second closed end having a hole therethrough aligned to the axis of the tube barrel weapon;

d. a cylindrical blast divider tube mounted through said hole in said second closed end, said cylindrical blast divider tube having a bore greater than the bore of said tube barrel weapon, a length of about 40% to about 85% of the axial length of said tubular main body, and being aligned with the axis of said tube barrel weapon, e. wherein said cylindrical blast divider tube creates a blind space formed along the length of said cylindrical blast divider tube between said cylindrical blast divider tube and said tubular main body and an expansion space formed between an end of said cylindrical blast divider tube and said muzzle of said tube barrel weapon, and wherein said blind space has an inlet opening occupying the full available cross-sectional area between said cylindrical blast divider tube and said tubular main body, thereby allowing unrestricted passage of expansion gases from said expansion space to said blind space.

2. An acoustical wave suppressor according to claim 1, wherein the length of said cylindrical blast divider tube is between about 50% and about 85% of the axial length of said tubular main body.

3. An acoustical wave suppressor according to claim 1, wherein the length of said cylindrical blast divider tube is between about 60% and about 85% of the axial length of said tubular main body.

4. An acoustical wave suppressor according to claim 1, wherein the distance between the end of said cylindrical blast divider tube and the mouth of the muzzle of the tube barrel weapon is between 50 and 150% of the diameter of said tubular main body.

5. An acoustical wave suppressor according to claim 4, wherein the distance between the end of said cylindrical blast divider tube and the mouth of the muzzle of the tube barrel weapon is between 70 and 150% of the diameter of said tubular main body.

6. An acoustical wave suppressor according to claim 4, wherein the distance between the end of said cylindrical blast divider tube and the mouth of the muzzle of the tube barrel weapon is between 85 and 150% of the diameter of said tubular main body.

7. An acoustical wave suppressor according to claim 1, which has adjustable mounting means for said cylindrical blast divider tube so that said acoustical wave suppressor can be tuned to accommodate different munitions.

* * * * *